US010325479B2

(12) United States Patent
Fateh et al.

(10) Patent No.: US 10,325,479 B2
(45) **Date of Patent: *Jun. 18, 2019**

(54) NETWORK-CONNECTED CAP FOR A CONTAINER

(71) Applicant: Kali Care, Inc., Mountain View, CA (US)

(72) Inventors: Sina Fateh, Mountain View, CA (US); Navid Afsarifard, Atherton, CA (US); Philippe Cailloux, Sunnyvale, CA (US)

(73) Assignee: KALI CARE, INC., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/011,506

(22) Filed: Jun. 18, 2018

(65) Prior Publication Data

US 2018/0301015 A1 Oct. 18, 2018

Related U.S. Application Data

(63) Continuation of application No. 15/460,115, filed on Mar. 15, 2017, now Pat. No. 10,026,296.
(Continued)

(51) Int. Cl.

| | |
|---|---|
| ***G08B 21/24*** | (2006.01) |
| ***A45D 40/00*** | (2006.01) |
| ***A45D 40/18*** | (2006.01) |
| ***B65D 41/04*** | (2006.01) |
| ***B65D 51/24*** | (2006.01) |
| ***B65D 85/00*** | (2006.01) |
| ***A45D 34/00*** | (2006.01) |

(52) U.S. Cl.
CPC ..... *G08B 21/245* (2013.01); *A45D 34/00* (2013.01); *A45D 40/0068* (2013.01);
(Continued)

(58) Field of Classification Search
CPC .... A45D 40/0068; A45D 40/18; A45D 34/00; G08B 21/245; B65D 41/04; B65D 51/245
See application file for complete search history.

(56) References Cited

U.S. PATENT DOCUMENTS 6,604,650 B2 8/2003 Sagar
6,789,497 B1 9/2004 Aiken
(Continued)

OTHER PUBLICATIONS

International Search Report and Written Opinion dated Jul. 6, 2017 for International Patent Application No. PCT/US2017/022671, 9 pages.

(Continued)

*Primary Examiner* — Leon Flores
(74) *Attorney, Agent, or Firm* — Perkins Coie LLP

(57) ABSTRACT

Network-connected (i.e., "smart") containers are described herein that include an electronic display on which personalized information can be presented. For example, the electronic display (and other necessary components, such as memory, processors, and communication modules) can be integrated into the cap or the body of a container, which holds a skin care product (e.g., a medication or a personal care product, such as a cosmetic) that is applied by the user as part of a skin care regimen. More specifically, a smart container can include an electronic display that presents relevant information to a user for review. Such information can include the name of the skin care product, textual instructions for complying with a skin care regimen, animations illustrating how to apply the skin care product, user information, messages (e.g., text messages delivered via a cloud service), notifications, and device information (e.g., battery status and network connectivity status).

18 Claims, 10 Drawing Sheets

Related U.S. Application Data

(60) Provisional application No. 62/309,863, filed on Mar. 17, 2016.

(52) U.S. Cl.
CPC ..... *A45D 40/18* (2013.01); *B65D 41/04* (2013.01); *B65D 51/245* (2013.01); *B65D 85/70* (2013.01); *A45D 2200/05* (2013.01); *A45D 2200/052* (2013.01)

(56) References Cited

U.S. PATENT DOCUMENTS

| | | | |
|---|---|---|---|
| 2006/0124655 | A1 | 6/2006 | Ratnakar |
| 2012/0287095 | A1 | 11/2012 | Cote et al. |
| 2014/0230377 | A1 | 8/2014 | Cartner et al. |
| 2014/0251850 | A1 | 9/2014 | Huang et al. |
| 2014/0266760 | A1 | 9/2014 | Burke et al. |
| 2015/0314141 | A1 | 11/2015 | Choi |
| 2015/0341302 | A1 | 11/2015 | Balachandran et al. |
| 2016/0159632 | A1 | 6/2016 | Wheatley et al. |
| 2016/0247345 | A1 | 8/2016 | Ratnakar et al. |
| 2016/0310355 | A1 | 10/2016 | Cheng |
| 2016/0321395 | A1 | 11/2016 | Colby et al. |
| 2017/0176238 | A1 | 6/2017 | Dubey et al. |
| 2017/0185746 | A1 | 6/2017 | Cameron |
| 2017/0224140 | A1 | 8/2017 | Vertegaal et al. |
| 2017/0270774 | A1 | 9/2017 | Fateh et al. |

OTHER PUBLICATIONS

Non-Final Office Action dated Oct. 25, 2017 for U.S. Appl. No. 15/460,115 of Fateh, S. et al., filed Mar. 15, 2017.

Notice of Allowance dated Mar. 16, 2018 for U.S. Appl. No. 15/460,115 of Fateh, S., filed Mar. 15, 2017.

NETWORK-CONNECTED CAP FOR A CONTAINER

CROSS-REFERENCE TO RELATED APPLICATIONS

This application is a continuation application of U.S. patent application Ser. No. 15/460,115, titled "NETWORK-CONNECTED CAP FOR A CONTAINER" and filed on Mar. 15, 2017, which claims priority to U.S. Provisional Patent Application No. 62/309,863 titled "SMART CAP FOR A CONTAINER" and filed on Mar. 7, 2016, which are incorporated by reference herein in their entirety.

FIELD OF THE INVENTION

Various embodiments concern network-connected (i.e., "smart") containers that include a display. More specifically, various embodiments relate to smart caps for containers that hold personal care products and present personalized information on an electronic display.

BACKGROUND

Skin care refers to a range of practices that improve skin health, such as nutrition, avoidance of excessive sun exposure, and appropriate use of emollients to enhance an individual's appearance (e.g., cosmetics, exfoliation, and peels). These practices support skin integrity by enhancing an individual's appearance, remediating skin break-downs, and/or relieving skin conditions. Completing a skin care regimen is a routine daily procedure for many individuals.

Oftentimes, a skin care regimen will require that specific skin care products be applied and/or that specific procedures be performed by individuals whose skin is too dry or moist, or to prevent/treat certain injuries or conditions (e.g., dermatitis). A skin care regimen could also be a component of a medical regimen. For example, skin care may be a component in improving wound healing, neonates, stomas, radiation treatment, and with some medications.

Many skin care regimens require that an individual apply a personal care product (which is intended to cleanse or beautify) and/or a medication (which is intended to diagnose, cure, mitigate, treat, or prevent a disease, or affect the structure or function of the body). Examples of personal care products include cosmetics, such as makeup, perfume, and lipstick. Examples of medications include sunscreen and acne creams. Other products, such as moisturizing sunscreens and anti-dandruff shampoos, are often considered to be examples of both categories.

BRIEF DESCRIPTION OF THE DRAWINGS

Various objects, features, and characteristics will become more apparent to those skilled in the art from a study of the following Detailed Description in conjunction with the appended claims and drawings, all of which form a part of this specification. While the accompanying drawings include illustrations of various embodiments, the drawings are not intended to limit the claimed subject matter.

Figure 1:
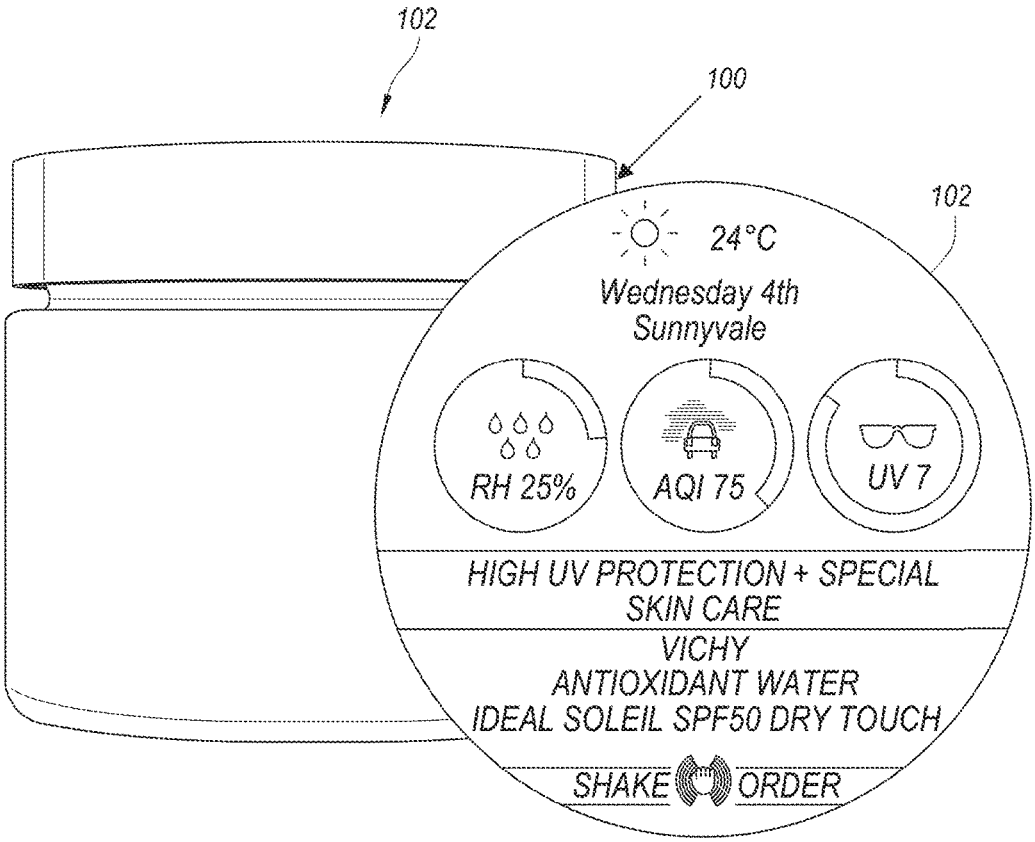
FIG. 1 includes a front view and a top view of a network-connected (i.e., "smart") cap that includes an electronic display.

The figures depict various embodiments described throughout the Detailed Description for the purposes of illustration only. While specific embodiments have been shown by way of example in the drawings and are described in detail below, the technology is amenable to various modifications and alternative forms. The intention is not to limit the technology to the particular embodiments described. Accordingly, the claimed subject matter is intended to cover all modifications, equivalents, and alternatives falling within the scope of the technology as defined by the appended claims.

DETAILED DESCRIPTION

Various embodiments are described herein that relate to network-connected (i.e., "smart") containers that include an electronic display on which personalized information can be presented. For example, the electronic display (and other necessary components, such as memory, processors, and communication modules) can be integrated into the cap or the body of a container. Oftentimes, the container will hold a skin care product (e.g., a medication or a personal care product, such as a cosmetic) that is applied by the user as part of a skin care regimen. A skin care regimen can, for example, identify which skin care product(s) are to be applied, the amount or quantity of skin care product to be applied, the time at which a skin care product should be applied, etc.

There are many reasons why an individual may routinely complete a skin care regimen. For example, an individual may apply cosmetics to enhance the individual's appearance or apply a medication to improve the individual's ability to heal a wound. However, in many instances skin care regimens can be improved by being tailored or personalized to the individual.

The smart containers described herein can include an electronic display that presents relevant information, such as the name of the skin care product, textual instructions for complying with a skin care regimen, animations illustrating how to apply the skin care product, user information, messages (e.g., text messages delivered via a cloud service), notifications, and device information (e.g., battery status and network connectivity status). The smart container could also display past, present, or future information about the ambient environment that is likely to impact whether the individual applies the skin care product and/or how much skin care product the individual should apply. For example, the electronic display of the smart container could present the current humidity, the high and/or low temperature expected for the day, or the current amount of ultraviolet (UV) radiation.

In some embodiments, the relevant information is used to generate and present (e.g., via the electronic display) personalized recommendations to the individual. For example, the smart container may recommend applying a particular skin care product (e.g., a moisturizing sunscreen, rather than a normal moisturizer) if the temperature or the UV radiation is expected to exceed a certain threshold.

The smart container may also include features (e.g., tactile user inputs, speakers, and microphones) that enable the individual to communicate with another entity regarding a skin care regimen. The other entity could be, for example, a cosmetic professional (e.g., a cosmetician) or a medical professional (e.g., a dermatologist). Additionally or alternatively, the smart container could be communicatively coupled to another computing device (e.g., a mobile phone, tablet computer, or laptop computer) that is able to access a network-accessible interface. The network-accessible interface may include information about various skin care products, skin care routines, etc. The network-accessible interface could be associated with (and/or managed by) the manufacturer of the smart container, a cosmetic entity (e.g., a cosmetician or a cosmetic company), a medical entity (e.g., a physician, a dermatologist, or a pharmacy), etc.

The network-accessible interface is preferably accessible through a web browser, a software program, a mobile application, and/or an over-the-top (OTT) application. Accordingly, the technology introduced here can be used with any computing device on which an individual can access the network-accessible interface and interface with the smart container, including personal computers, tablet computers, personal digital assistants (PDAs), mobile phones, game consoles (e.g., Sony PlayStation® or Microsoft Xbox®), music players (e.g., Apple iPod Touch®), wearable electronic devices (e.g., a watch or fitness band), network-connected devices (e.g., a television), virtual/augmented reality systems (e.g., Oculus Rift® or Microsoft Hololens®), or other electronic devices.

Terminology

Brief definitions of terms, abbreviations, and phrases used throughout this application are given below.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not others.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. For example, two devices may be coupled directly to one another, or via one or more intermediary channels or devices. Devices may also be coupled in such a way that information can be passed there between, while not sharing any physical connection with one another.

Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list. If the specification states a component or feature "may," "can," "could," or "might" be included or have a characteristic, that particular component or feature is not required to be included or have the characteristic.

The term "module" refers broadly to software, hardware, and/or firmware components. Modules are typically functional components that can generate useful data or other output using specified input(s). A module may or may not be self-contained. A software program or application may include one or more modules.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that the same element can be described in more than one way.

Consequently, alternative language and synonyms may be used for some of the terms discussed herein. Although synonyms for certain terms may be provided, special significance is not to be placed on whether or not a term is elaborated or discussed herein. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

System Topology Overview

FIG. 1 includes a front view and a top view of a network-connected (i.e., "smart") cap 100 that includes an electronic display 102. Here, the smart cap 100 is for a container that holds a moisturizing cream. However, the container could hold various types skin care products (e.g., another personal care product or a medication). In fact, in some embodiments the container may include multiple skin care products.

Although FIG. 1 depicts a smart cap 100, one skilled in the art will recognize that the electronic display 102 and/or other necessary components (e.g., a memory, one or more processors, and a communication module) can be housed within the cap, the body of the container, or distributed between the cap and the body of the container.

Generally, the electronic display 102 is a memory display with a persistent (i.e., "always-on") display that consumes minimal power, such as E Ink. However, the electronic display 102 could also be a liquid crystal display (LCD), light-emitting diode (LED) display, organic light-emitting diode (OLED) display, etc. In some embodiments, the electronic display 102 is touch-sensitive and provides touch functionality. Touch functionality may allow a user to input messages, answer questions posed by the smart cap 100, etc. For example, the electronic display 102 may pose a question that can be answered by selecting a digital button that is presented on the electronic display (e.g., a "Yes" button or a "No" button). The question may be visually presented on the electronic display 102 and/or audibly projected from one or more speakers.

The electronic display 102 preferably serves as an interactive digital label. For example, the electronic display 102 may allow the user to readily exchange information with a cloud-based service configured to provide recommendations regarding a skin care regimen, cosmetic professionals (e.g., beauty advisers, cosmeticians), cosmetic companies, medical professionals (e.g., dermatologists, nurses, pharmacists), medical entities (e.g., hospitals, pharmacies), etc. Information uploaded by the user for transmittal may include descriptions of side effects experienced by the user, a list of other skin care products owned or used by the user, answers to questions previously posed by a cosmetic professional or medical professional, etc.

The electronic display 102 can be configured to facilitate the exchange of automated content and/or allow the user to easily communicate with others across a network. For example, the electronic display 102 could present skin care recommendations based on the pollution level, humidity, UV index, characteristics of the user's skin, the user's location, other skin care products readily available to the user, etc. Other information could also be presented on the electronic display 102, such as:

- Instructions regarding how to apply/administer a skin care product;
- Relevant information about a skin care product, such as special characteristics (e.g., whether the skin care product is intended for high UV protection, sensitive skin, etc.) and possible side effects;
- Personal information about the user (e.g., from a user profile);
- Messages pushed to the smart container (e.g., directly from the cloud-based service or from the cloud-based service via a mobile application executing on the user's computing device);
- Information regarding the remaining contents of the container; and
- Device information (e.g., battery status and network connectivity status).

Here, the electronic display 102 is disposed on the top of a smart cap 100. However, one skilled in the art will recognize that the electronic display 102 could instead be disposed on a different part of the cap (e.g., along the edge of the cap) or on the body of the container. In some embodiments, the container may include multiple electronic displays that present the same or different types of information.

The smart cap 100 can also include one or more light sources that are able to provide visual reminders to administer the skin care product. In some embodiments, the light source(s) are multicolor LEDs that visually convey information to the user. For example, the light source(s) may pulse red when the user is due to apply the skin care product, green when the skin care product has been applied, and blue when the smart cap 100 is establishing a network connection or receiving/transmitting information. Generally, the light source(s) are coupled to opposing sides of the smart cap 100 and, therefore, are visible on multiple sides. However, in some embodiments the light source(s) may only be visible on some subset of the sides of the smart cap 100 and/or body of the container.

The smart cap 100 could also include one or more ambient sensors that are configured to track ambient conditions (e.g., temperature, humidity, ambient or "available" light, UV light). For example, the ambient sensor(s) may include a camera configured to capture the user's interactions with the local environment, a light sensor configured to track ambient light levels, a humidity sensor configured to monitor local humidity, a thermometer configured to monitor local temperature, etc. These environmental factors (and others) may have an effect on which skin care products are recommended by the smart cap 100. For example, changes in humidity and/or UV light may affect whether the smart cap 100 recommends applying a normal moisturizer or a moisturizing sunscreen that has high UV protection. Each of the ambient sensor(s) may be configured to measure values for the local environment, for the inside of the container (i.e., where the skin care product is stored), or both.

A power supply connection may also be coupled to, or configured within, the smart cap 100. For example, the smart cap 100 could include a standard Universal Serial Bus (USB) port through which power can be provided. Alternatively or additionally, other ports may be used that support micro-USB, Lightning, SATA cables, unique proprietary connectors, etc. The smart cap 100 could also include a battery compartment within which one or more batteries (e.g., AA, AAA, lithium button) are stored. Further yet, the smart cap 100 may include power supply connection(s) along the sides and/or bottom of the cap or body of the container that allow the smart cap 100 to be placed within a charging station for charging. In some embodiments, the smart cap 100 is charged using inductive charging. More specifically, the smart cap 100 may be charged via resonant inductive coupling by placing the cap or entire container on top of a power transmission pad. Those smart caps 100 configured for low power inductive transfer of power typically do not have an external power supply connection. However, in some instances, it may be preferable for the smart cap 100 to be chargeable in numerous ways (e.g., via a USB port and via wireless charging in conformance with the Qi standard).

Figure 2:
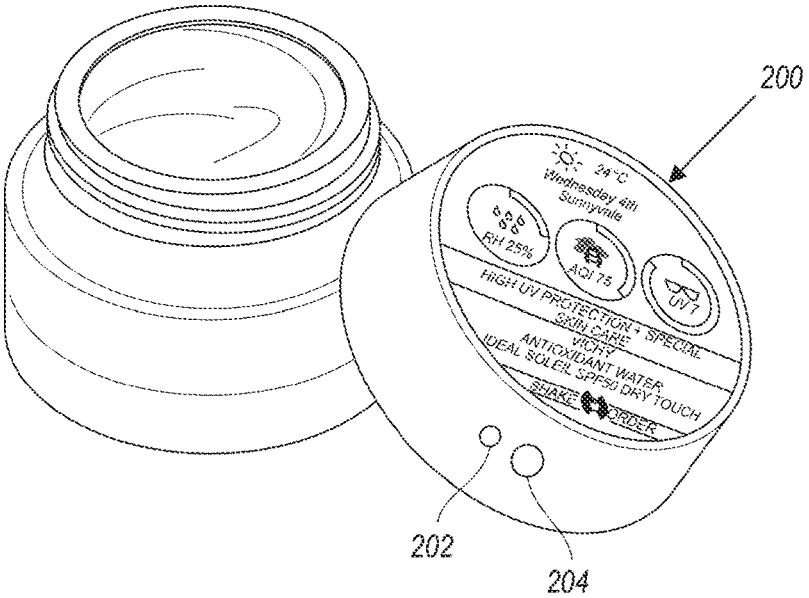
FIG. 2 is a perspective view of a smart cap that includes at least one audio sensor and at least one audio speaker.

FIG. 2 is a perspective view of a smart cap 200 that includes at least one audio sensor 202 and at least one audio speaker 204. The audio speaker 204 is configured to generate tones, voice prompts, custom sounds, or some combination thereof. For example, these sounds may provide an audible reminder that a particular skin care product (e.g., sunscreen) should be administered based on current or upcoming environmental conditions. The audio sensor 202 (e.g., a microphone), meanwhile, is able to record sound produced by or near the smart cap 200. Consequently, the user may be able to audibly communicate with a cosmetic professional or medical professional before, during, or after applying the skin care product held within the container. Together, the audio sensor 202 and audio speaker 204 can be used to enable real-time (or near real-time), two-way voice communication. Such communications may correspond to information or animations presented on the electronic display.

Various embodiments of the smart cap 200 enable personalized skin care recommendations to be presented that can be modified in real time. For example, the smart cap 200 may recommend a particular skin care product based on the current or expected pollution, humidity, or UV levels of the local environment. Thus, the smart cap 200 may provide a user immediate access to knowledge about which skin care products are most likely to be appropriate under the circumstances.

All of the necessary components (e.g., processors, memory, electronic display, communication modules) could be housed solely within the cap. In such embodiments, the cap may be reusable so long as it is able to fit multiple containers. Moreover, a smart cap 200 may include technology (e.g., an RFID sensor) that allows it to easily "mate" with the bodies of different containers and acquire certain information from a memory housed within the body. For example, when a smart cap is placed on the body of a new container, the smart cap may retrieve information from the memory, such as the type of skin care product held within the container, characteristics of that skin care product, etc.

The technology introduced here may operate as an "invisible" technology. That is, the user may be able to take advantage of the benefits enabled by the smart cap without needing to complete setup processes, installation processes, maintenance processes, etc. For example, some embodiments of the smart cap 200 can produce personalized recommendations from information that is retrieved from existing user accounts and applications. In such embodiments, the techniques introduced here may be facilitated by powerful back-end operations that are performed by a remote service that is communicatively coupled to the smart cap 200 and/or a computing device associated with the user.

Figure 3:
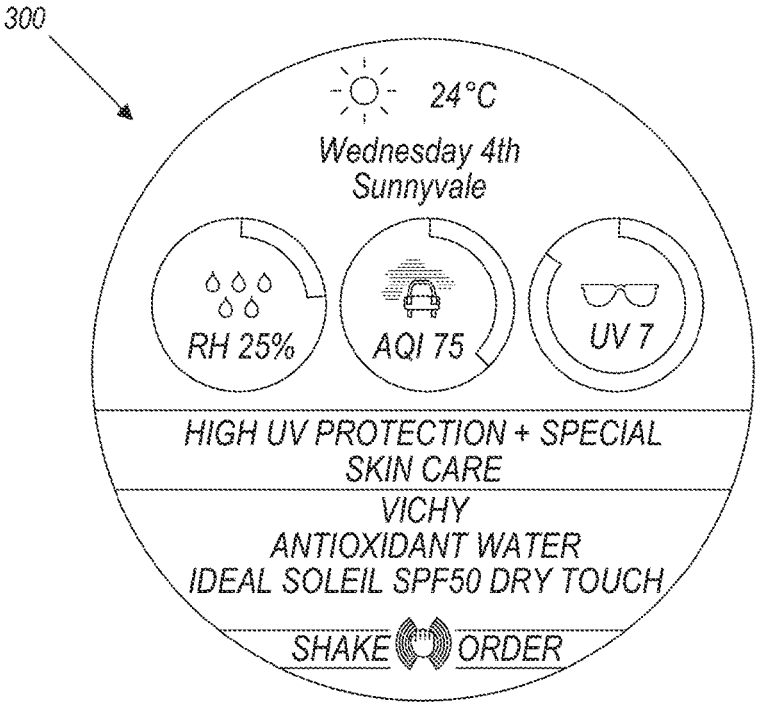
FIG. 3 depicts an electronic display that could be included in a smart container.

FIG. 3 depicts an electronic display 300 that could be included in a smart container. For example, the electronic display 300 may be integrated within the cap or the body of the container. The electronic display 300 could be a persistent (i.e., "always-on") display that consumes minimal power, such as E Ink. The electronic display 300 may also be able to present personalized information that is updated in real-time. For example, recommendations for skin care products could be presented at predetermined times (e.g., after the user wakes up or before the user goes to sleep). Additionally or alternatively, recommendations for skin care products could be presented upon receiving input indicative of a user request to provide recommendations (e.g., a verbal command or physical interaction). As another example, recommendations could be made automatically for upcoming days based on the expected weather, humidity, UV, etc. These recommendations could specify which skin care product(s) the user should be applying or ordering.

The electronic display 300 may be configured to present relevant information, such as cosmetic and/or medication information, textual instructions, animations, user information, messages (e.g., text messages delivered via a cloud service), notifications, and device information (e.g., battery status, network connectivity status).

The smart container or cap may also include user input component(s), such as buttons, a touch-sensitive electronic display, a microphone and processor employing voice recognition techniques, a camera and processor employing gesture recognition techniques, motion sensors, etc. Input(s) could also be provided using another computing device, such as a mobile phone, tablet, or laptop, that is paired with (i.e., communicatively coupled to) the smart container or cap.

Accordingly, the smart container or cap can include one or more communication modules that facilitate communication with the computing device and/or a remote server across one or more networks, such as the Internet, a local area network (LAN), a wide area network (WAN), a point-to-point dial-up connection, a cellular network, etc. For example, a smart cap may include a first communication module for communicating with the remote server via WiFi and a second communication module for communicating with the computing device via a short range protocol (e.g., near-field communication (NFC), radio-frequency identification (RFID), Bluetooth).

Figure 4:
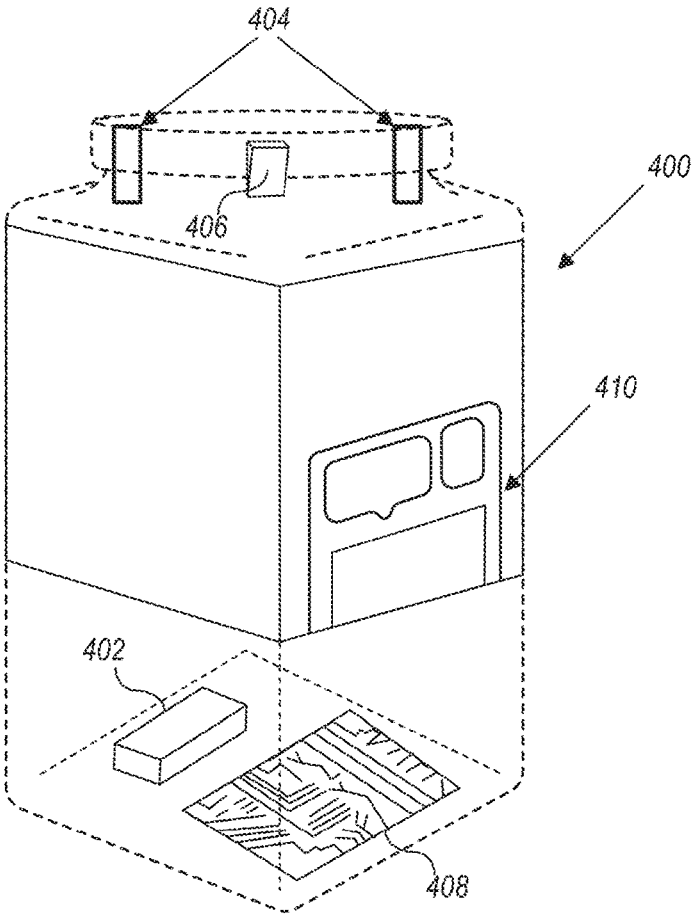
FIG. 4 includes a partial cutaway illustration of a smart container in accordance with some embodiments.

FIG. 4 includes a partial cutaway illustration of a smart container 400 in accordance with some embodiments. The smart container 400 can include a motion sensor 402, a pair of conductive elements 404, a lid sensor 406, and a communication module 408 in addition to an electronic display 410. Some or all of these components could also be included in the cap of the smart container 400.

The motion sensor 402 generates motion sensor data that represents movement of the smart container 400. Consequently, the motion sensor data can indicate when tilting, shaking, etc., occur as a user interacts with the smart container 400. The motion sensor 402 can also identify vibrations resulting from, for example, skin care product shifting in the container. Generally, the motion sensor 402 is a multi-axis (e.g., 4 axis, 6 axis) sensor capable of recognizing actions performed by the smart container 400. The motion sensor 402 may also be capable of receiving and installing over-the-air (OTA) firmware updates when the smart container includes a communication module 408.

The motion sensor data can be analyzed to determine physical movement or motion of the smart container 400. For example, movement experienced by the motion sensor 402 may cause an electronic display (e.g., electronic display 102 of FIG. 1) to illuminate. As another example, a motion sensor 402 can generate an acceleration vector from the motion sensor data, which represents acceleration of the motion sensor 402 (and the smart container 400) along the vector. The motion can then be analyzed to determine whether it matches a distinctive motion associated with opening the container and, therefore, application of a skin care product. In some embodiments, the motion sensor data and/or associated motion(s) can be further analyzed to determine the amount skin care product dispensed from the smart container 400. For example, if the user takes off the cap and tilts the smart container 400, more skin care product may have been dispensed or little skin care product may be held by the smart container 400.

Contents of the smart container 400 could be determined using at least one pair of conductive elements 404 that are placed substantially parallel to one another. These conductive elements 404 are preferably positioned at or near the rim of the container or the lid. As skin care product leaves the container and travels between the conductive elements 404, the relative static permittivity of the area between the conductive elements 404 changes and the subsequent change in capacitance can be measured. The changes in capacitance, and the capacitance measurements themselves, may be used to determine whether skin care product was dispensed from the container and, if so, how much skin care product was dispensed.

More than one pair of conductive elements could also be placed within the opening of the container 400. In such embodiments, each pair of conductive elements 404 is configured to generate a separate capacitance measurement. When used together, these measurements are able to generate a more accurate measurement of the change in capacitance that is less susceptible to noise. For example, a smart container 400 having a rectangular opening could have two pairs of conductive plates along its side walls, while a container having a hexagonal opening could have three pairs of conductive plates. A pair of conductive elements 404 may also be placed along the top (e.g., bottom of the lid) and bottom of the smart container 400 that are configured to measure the amount of skin care product remaining in the smart container 400. If the amount of skin care product is determined to have fallen past a lower threshold, the electronic display 410 may present a reminder to order additional skin care product, schedule an appointment with a cosmetic/medical professional, etc. The user may be able to acknowledge the reminder in several different ways. For example, in some embodiments the reminder may prompt the user to shake the smart container 400 in order to place an order for a renewed prescription, while in other embodiments the reminder may prompt the user to utter a verbal response indicating whether additional skin care product(s) are required.

Sensor data can also be generated by a lid sensor 406 that determines whether the smart container 400 is open or closed. The lid sensor 406 may be, for example, an optical sensor that is oriented toward the opening of the smart container 400, a pressure sensor (e.g., a wing pressure mechanism) upon which pressure is exerted when the lid is attached to the body of the smart container 400, etc. The communication module 408, meanwhile, is configured to establish a connection with one or more other computing devices. Examples of computing devices include mobile phones, tablet computers, laptop computers, portable media devices, wearable devices, servers, etc.

The connection allows information (e.g., user input, measurements) recorded by the electronic display 410, audio sensor, user input(s), ambient sensor(s), motion sensor 402, conductive elements 404, lid sensor 406, etc., to be transmitted electronically across a network. Generally, the communication module 408 establishes a wireless communication link between the smart container 400 and one or more other computing devices. For example, the smart container 400 may support transceivers that communicate in accordance with various protocols, including Bluetooth, Bluetooth Low Energy (BLE), cellular standards (e.g., LTE, 3G, 4G), near field communication (NFC), wireless local area network (WLAN) standards (e.g., using WiFi/IEEE 802.11 compliant transmitter), and/or other wireless technologies. Additionally or alternatively, the smart container 400 could be configured to transfer sensor data via a wired connection (e.g., USB, mini-USB). For example, the smart container 400 may automatically upload sensor data while being charged.

The communication module 408 can be housed within an electronics module compartment, which may also house additional modules and/or components (e.g., processors, communication devices, integrated electronics, memory storage devices, batteries, sensors). For example, in some embodiments the electronics module compartment includes a gesture recognition module that can be used to detect movement and position of the smart container 400. The electronics module compartment may be removable from the smart container 400. Accordingly, the user may elect to remove and reuse several different components described herein (e.g., the electronic module compartment, the cap, and even the container itself).

One skilled in the art will recognize embodiments of the smart device can include some or all of the components described herein with respect to FIGS. 1-4. Some embodiments may include only an electronic display, while other examples include most or all of the aforementioned components. Moreover, some embodiments may include additional components not pictured or described herein that enable the smart container to provide personalized information in real time.

Figure 5:
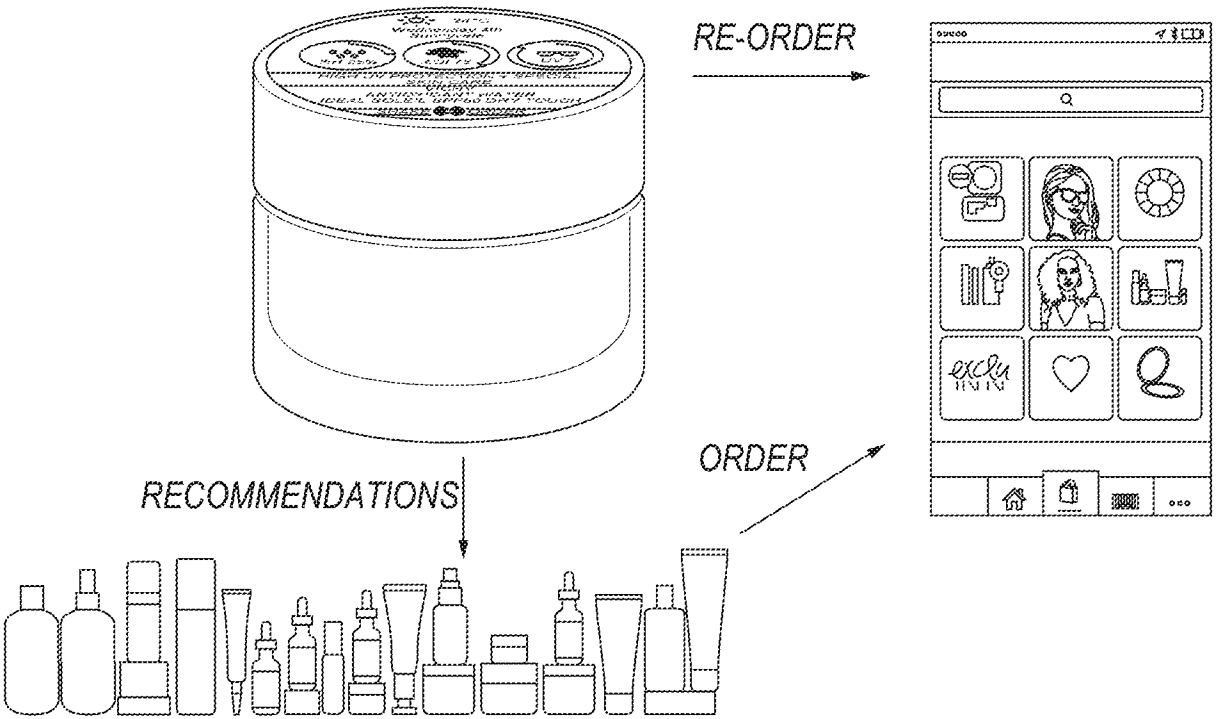
FIG. 5 is a generalized flow diagram illustrating how the smart container may be part of a larger ecosystem concerning skin care products.

FIG. 5 is a generalized flow diagram illustrating how the smart container may be part of a larger ecosystem concerning skin care products. For example, the ecosystem could include:

- Computing devices, such as mobile phones, tablet computers, and laptop computers, that are operated by a user or other individuals (e.g., cosmetic professionals and medical professionals) who are able to provide recommendations for skin care products;
- Databases that include information about skin care products and skin care regimens; and
- A network-accessible interface through which the user may be able to search for additional information about skin care products, modify a skin care regimen, communicate with a cosmetic professional or medical professional, place an order for a skin care product, etc.

The network-accessible interface is preferably accessible through one or more of a web browser, a software program, a mobile application, and an over-the-top (OTT) application. For example, the user may be able to connect to a remote server using a mobile application executing on the user's mobile phone. Moreover, the mobile application may permit the user to instantly place an order for additional skin care product(s) (e.g., by renewing a prescription), order new skin care product(s), order sample(s), etc.

Figure 6:
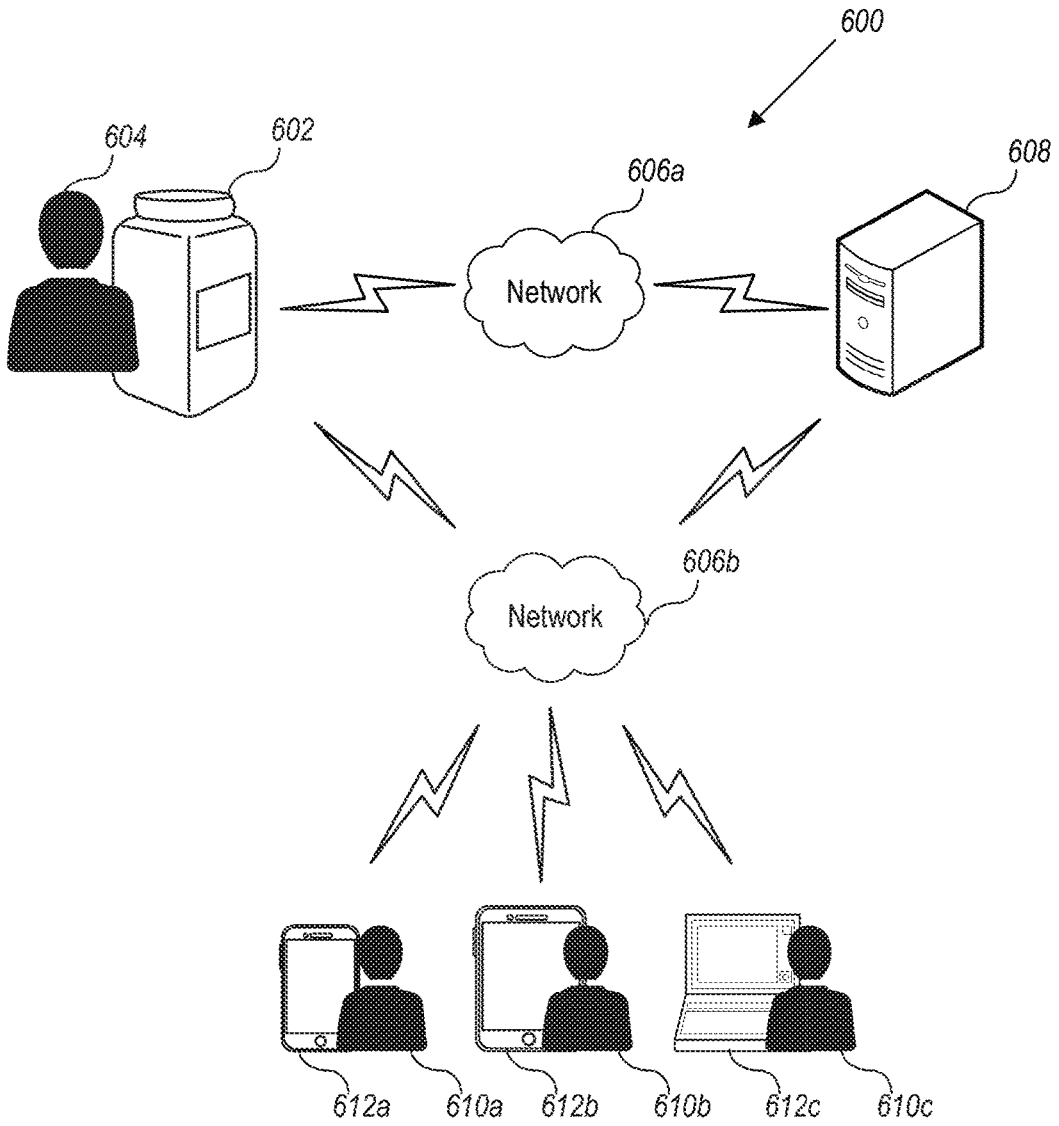
FIG. 6 includes a high-level system diagram of components of a system for monitoring whether a skin care product is applied by a user in accordance with a regimen.

FIG. 6 includes a high-level system diagram of components of a system 600 for monitoring whether a skin care product is applied by a user 604 in accordance with a regimen. In some embodiments, a smart container 602 is communicatively coupled to a distinct computing system 608 (e.g., server) over a network 606*a*, such as the Internet, a LAN, a WAN, a point-to-point dial-up connection, or a cellular network. The smart container 602 and/or the distinct computing system 608 can perform some or all of the tasks described herein. That is, the system 600 can be distributed amongst the smart container 602 and the distinct computing system 608. Such distribution of tasks may allow the system 600 to monitor compliance with the regimen in a more intelligent manner. For instance, certain time-sensitive processing tasks may be performed by the smart container 602, while other processing tasks may be performed by the distinct computing system 608 to preserve the limited processing resources of the smart container 602.

In some embodiments, one or more network-accessible computing devices 612*a-c* that are controlled by other individuals (e.g., family and friends of the user), cosmetic professionals, medical professionals, etc., 610*a-c* are communicatively coupled to the smart container 602, the distinct computing system 608, or both. One or more networks 606*a-b* can be used to communicatively couple the various components of the system 600. Network 606*a* can be the same as, or distinct from, network 606*b*.

Such a configuration allows the other individuals (e.g., family and friends of the user), cosmetic professionals, medical professionals, etc., 610*a-c* to provide recommendations to the user 604 before, during, or after the skin care product is applied. For example, a family member may send a message to an identifier associated with the smart container 602 (e.g., a phone number or email address) that causes the smart container 602 to generate a reminder to apply a skin care product. As another example, a family member may receive a message (e.g., a text message, email message, or push notification via an application) that specifies the user dispensed the skin care product from the smart container 602 (and thus likely applied the skin care product in accordance with the regimen). While the smart container 602, distinct computing system 608, and network-accessible devices 612*a-c* are depicted as wirelessly communicating with one another, wired connections are also possible and, in some embodiments, may be preferred.

Figure 7:
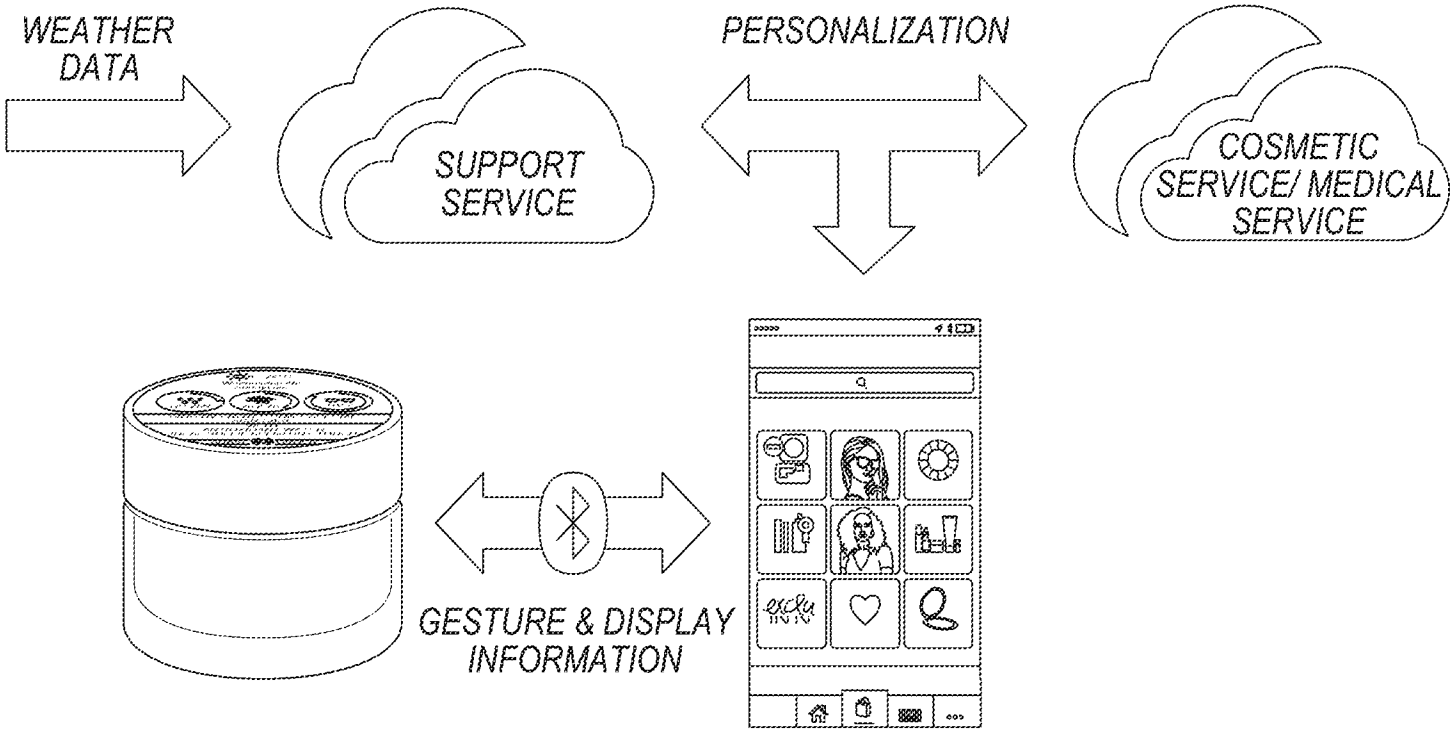
FIG. 7 is a generalized flow diagram illustrating how data can flow from one or more sources to the smart container either directly or via a computing device (e.g., a mobile phone, tablet computer, or laptop computer) that is paired with (i.e., communicatively coupled to) the smart container.

FIG. 7 is a generalized flow diagram illustrating how data can flow from one or more sources to the smart container either directly or via a computing device (e.g., a mobile phone, tablet computer, or laptop computer) that is paired with (i.e., communicatively coupled to) the smart container. In some embodiments the data is dispatched directly to a communication module of the smart container, while in other embodiments the data is dispatched to a mobile application executing on a computing device (which forwards the data to the smart container).

The sources can include, for example, a cloud-based system associated with the manufacturer of the smart container (also referred to as a "support service") and/or a cloud-based system associated with a cosmetic entity (also referred to as a "cosmetic service") or a medical entity (also referred to as a "medical service"). Other sources may also interface with the smart container, including weather services, Global Positioning System (GPS) services, etc. Oftentimes, the sources will periodically upload relevant data (e.g., skin care regimens, information about skin care products, weather data) to the smart container. In some embodiments, certain information (e.g., weather) is configured to be automatically retrieved from one or more of these services by the smart container. For example, the smart container may submit requests for updated information in accordance with a predetermined schedule (e.g., once per day, once per hour).

However, as shown in FIG. 7, this can be done by transmitting the relevant data directly to the smart container or to a computing device that is communicatively coupled to the smart container. Oftentimes, the computing device will be configured to display an interface that enables the relevant data to be easily accessed and reviewed. The smart container can be communicatively coupled to the computing device and/or sources by wired or wireless connections. For example, the smart container may communicate with the computing device over a Bluetooth connection and the source(s) of relevant data (which may be hosted on network-connected servers) over a WiFi connection.

Figure 8:
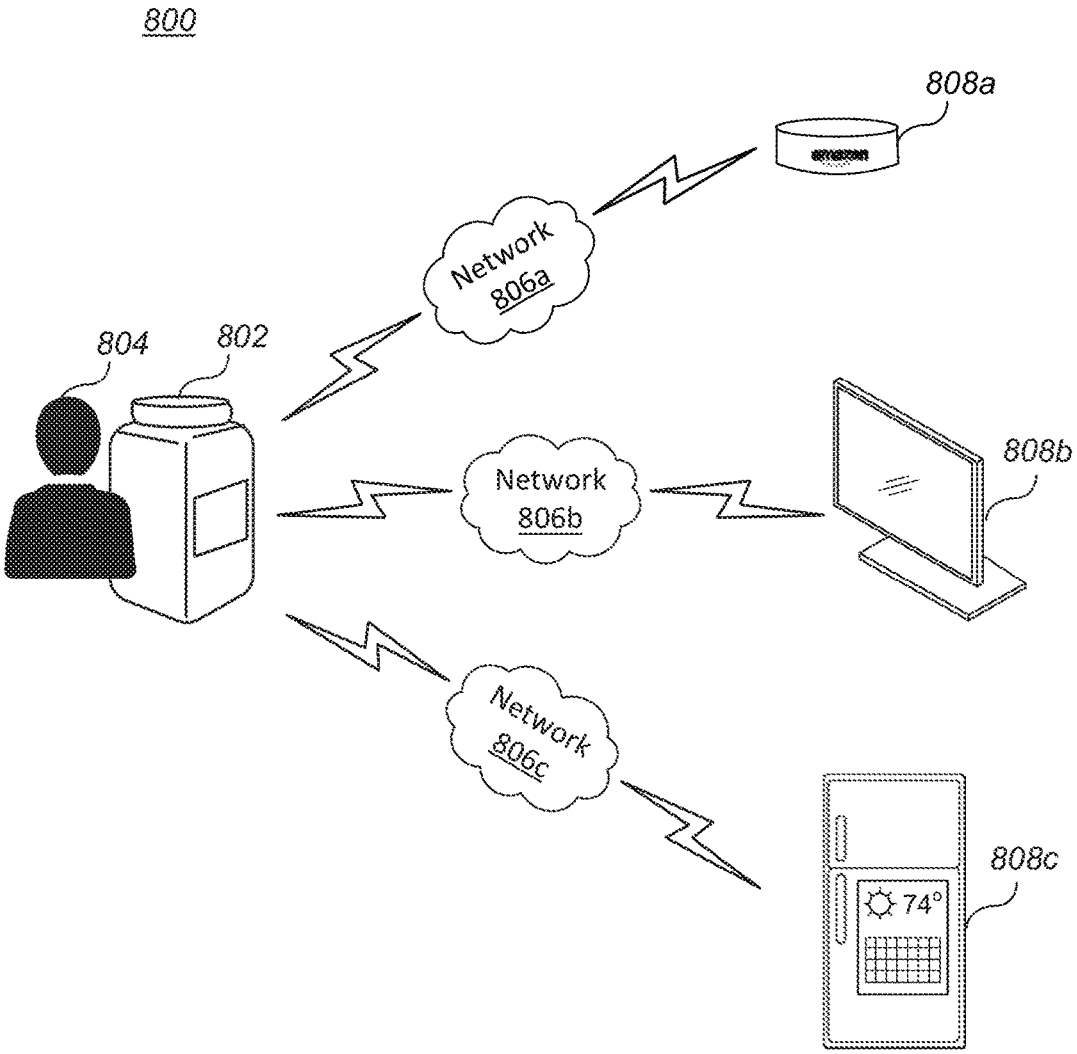
FIG. 8 includes a high-level system diagram of network-connected components of a smart home system for monitoring whether a skin care product is applied by a user in accordance with a regimen.

FIG. 8 includes a high-level system diagram of network-connected components of a smart home system 800. The smart home system 800 may be used to monitor whether a skin care product is applied by a user 804 in accordance with a regimen.

More specifically, the smart home system 800 can include a network-connected container 802 and one or more other network-connected devices 808*a-c*. The network-connected devices 808*a-d* can include, for example, light bulbs, thermostats, kitchen appliances (e.g., microwaves, refrigerators, and ovens), vacuums, health appliances (e.g., scales and fitness trackers), security systems, cameras, speakers, wearable devices (e.g., watches), computing hubs (e.g., Amazon Echo® and Google Home®), and other devices (e.g., mobile phones, televisions, gaming consoles, and computers). The network-connected container 802 is communicatively coupled to each of the other network-connected devices 808*a-c* over a network 806*a-c*, such as the Internet, a LAN, a WAN, a point-to-point dial-up connection, or a cellular network. Short range wireless communication channels may additionally or alternatively be established between these devices via Bluetooth, Near Field Communication (NFC), etc.

The network-connected container 802 and the other network-connected devices 808*a-c* can perform some or all of the tasks described herein. That is, components can be intelligently distributed amongst the network-connected container 802 and the other network-connected devices 808*a-c*.

For example, in some embodiments an electronic display and one or more sensors (e.g., a light sensor, humidity sensor, and/or microphone) are integrated into the network-connected container 802. These components could be integrated into the cap, the body of the container, or both.

As another example, the network-connected container 802 may make use of an electronic display and one or more sensors (e.g., (e.g., a light sensor, humidity sensor, and/or microphone) that are already present in some or all of the other network-connected devices 808*a-c*. For instance, the network-connected container 802 may push information to a television upon determining an individual watching the television needs to be notified to administer a skin care product housed within the network-connected container 802. Similarly, the network-connected container 802 may prompt a refrigerator to issue a notification to administer the skin care product upon determining the individual is in the kitchen or recently interacted with the refrigerator. One skilled in the art will recognize that the network-connected devices listed above can be used in various ways to facilitate adherence to a skin care regimen (or some other type of medication regimen if the network-connected bottle 802 includes a medicament or substance in another form, such as pills, powder, or liquid).

Moreover, the electronic display and sensor(s) may be intelligently distributed amongst the network-connected container 802 and the other network-connected devices 808*a-c*. For instance, the network-connected container 802 may include sensors configured to sense characteristics of the ambient environment but no electronic display. In such embodiments, the network-connected container 802 can instead rely on the other network-connected devices 808*a-c* to present information to the user 804 (e.g., visually on a television, tactilely through a wearable device, and/or audibly through a computing hub).

Figure 9:
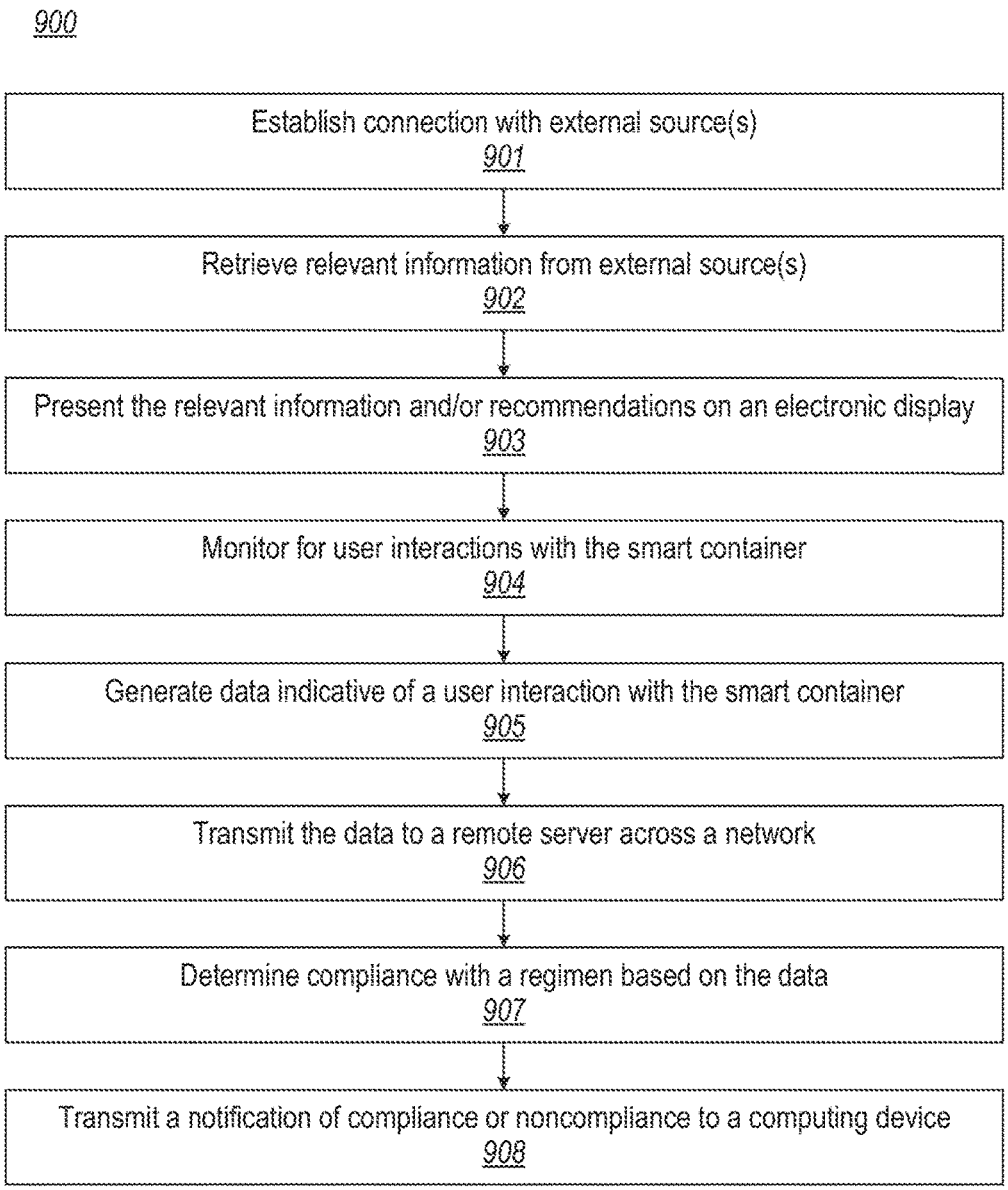
FIG. 9 depicts a process for monitoring the compliance of a user who applies a skin care product housed within a network-connected (i.e., "smart") container.

FIG. 9 depicts a process 900 for monitoring the compliance of a user who applies a skin care product housed within a network-connected (i.e., "smart") container. The smart container initially establishes a connection with one or more external sources of information (step 901). The external source(s) may, for example, be in the form of network-accessible databases, services, etc. Accordingly, the smart container may include program code specifying how to interface with application programming interfaces (APIs) of specific external source(s). For example, the smart container may include separate instruction sets for interfacing with a support service, a cosmetic service, a medical service, a weather service, a GPS service, etc.

The smart container can then subsequently retrieve relevant information from the external source(s) (step 902). For example, the smart container may receive details regarding a skin care product from the cosmetic service, details regarding a medication regimen from the medical service, and details regarding upcoming weather patterns from the weather service.

In some embodiments, the smart container receives or generates one or more recommendations for applying the skin care product to maintain compliance with the medication regimen. For example, the smart container may determine that additional moisturizer should be applied by the user if the weather service indicates the upcoming weather is expected to be dry. As another example, the smart container may recommend that the user apply a moisturizing sunscreen rather than a normal moisturizer if UV radiation is expected to exceed a certain threshold. Accordingly, the smart container may present the relevant information and/or the recommendation(s) on an electronic display (step 903).

The smart container can then monitor for user interactions with the smart container using one or more sensors (step 904). In some embodiments the smart container includes a motion sensor that detects movement of the smart container, while in other embodiments the smart container includes a microphone that detects user utterances. FIGS. 1-4 depict other examples of sensors that can be used to detect user interactions with the smart container. The sensor(s) generate data indicative of a user interaction with the smart container (step 905). Such data may be in the form of motion sensor data, raw audio recordings, input indicative of a user interaction with the electronic display, pressure sensor data generated by a pressure sensor that indicates whether the cap has been removed, etc.

The data can then be transmitted to a remote server across a network (step 906). The remote server may be managed by the manufacturer of the smart container or some other entity. After analyzing the data, the remote server can determine compliance with a medical regimen (step 907). Said another way, compliance with the medical regimen can be determined based on user interactions with the smart container. More specifically, the remote server can parse the data to determine whether events captured within the data correspond to applications of the skin care product. For example, the remote server may analyze motion sensor data to determine whether the cap of the smart container was removed at the appropriate times as required by the medical regimen.

In some embodiments, the remote server transmits a notification or compliance or noncompliance to a computing device (step 908). The computing device may be associated with the user or another individual (e.g., a family member or medical professional). For example, the remote server may send a notification to the user that prompts the user to apply the skin care product. As another example, the remote server may send a notification to a medical professional (e.g., a dermatologist or nurse) that specifies the user applied the skin care product at the appropriate time.

Unless contrary to physical possibility, it is envisioned that the steps described above may be performed in various sequences and combinations. For example, in some embodiments the smart container may not retrieve the relevant information from the external source(s) until prompted to do so by the user. Additional steps could also be included in some embodiments. For example, the smart container may pose questions to the user before, during, or after applying the skin care product. Such questions may include whether the user has previously experienced any side effects after applying the skin care product, whether the user is currently in good health, whether additional skin care product will be necessary in the near future, etc. Responses can be delivered to the remote server or another computing device (e.g., a request to refill a prescription may be delivered directly to a pharmacy).

One skilled in the art will also recognize that the steps described above can be performed by the smart container, the remote server, or some other computing device. In fact, in some embodiments the tasks are intelligently distributed between the smart container, the remote server, and a mobile phone associated with the user.

Processing System

Figure 10:
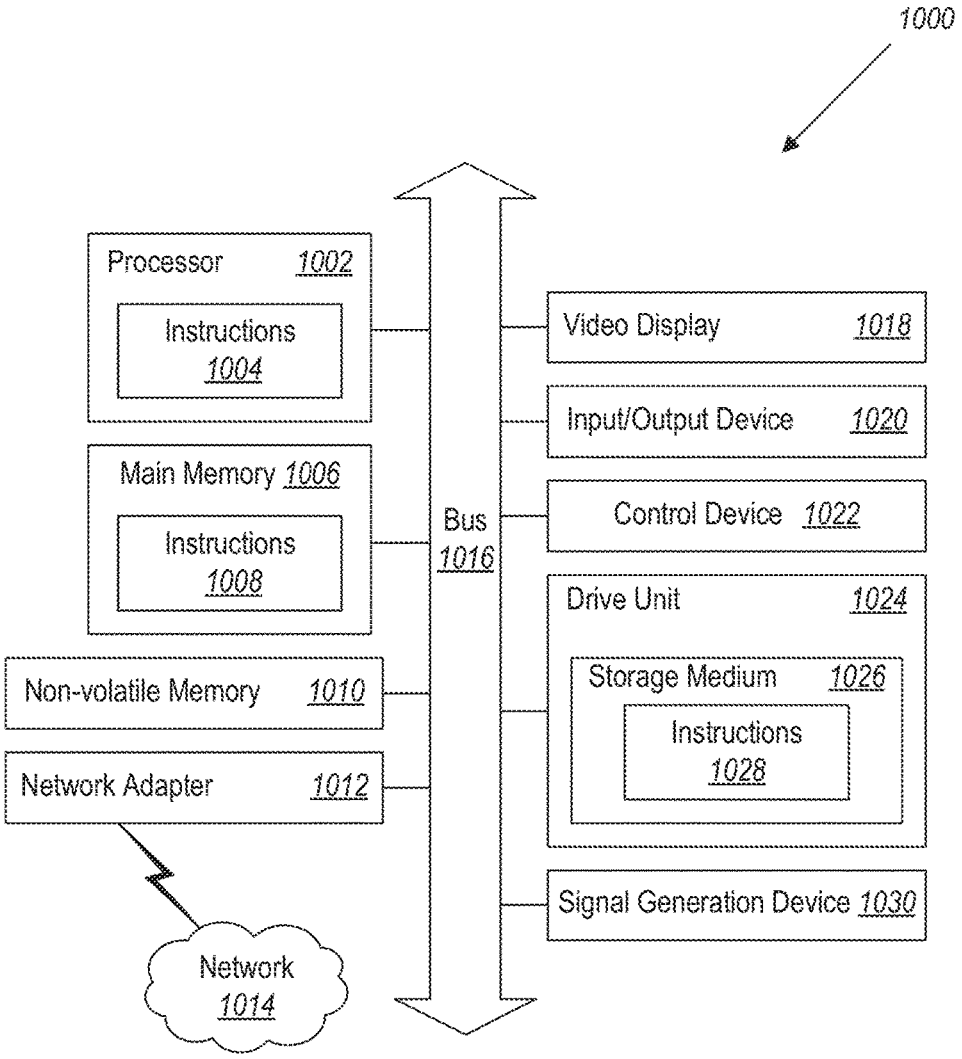
FIG. 10 is a block diagram illustrating an example of a processing system in which at least some operations described herein can be implemented.

FIG. 10 is a block diagram illustrating an example of a processing system 1000 in which at least some operations described herein can be implemented. The processing system may include one or more central processing units ("processors") 1002, main memory 1006, non-volatile memory 1010, network adapter 1012 (e.g., network interfaces), video display 1018, input/output devices 1020, control device 1022 (e.g., keyboard and pointing devices), drive unit 1024 including a storage medium 1026, and signal generation device 1030 that are communicatively connected to a bus 1016. The bus 1016 is illustrated as an abstraction that represents any one or more separate physical buses, point to point connections, or both connected by appropriate bridges, adapters, or controllers. The bus 1016, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the processing system 1000 operates as a standalone device, although the processing system 1000 may be connected (e.g., wired or wirelessly) to other machines. For example, in some embodiments components of the processing system 1000 are housed within a computer device used by a user to access an interface having skin care products or skin care regimens, while in other embodiments components of the processing system 1000 are housed within a network-connected container that holds one or more skin care products. In a networked deployment, the processing system 1000 may operate in the capacity of a server or a client machine in a client-server network environment, or as a peer machine in a peer-to-peer (or distributed) network environment.

The processing system 1000 may be a server, a personal computer (PC), a tablet computer, a laptop computer, a personal digital assistant (PDA), a mobile phone, a processor, a telephone, a web appliance, a network router, switch or bridge, a console, a hand-held console, a (hand-held) gaming device, a music player, any portable, mobile, hand-held device, or any machine capable of executing a set of instructions (sequential or otherwise) that specify actions to be taken by the processing system.

While the main memory 1006, non-volatile memory 1010, and storage medium 1026 (also called a "machine-readable medium) are shown to be a single medium, the term "machine-readable medium" and "storage medium" should be taken to include a single medium or multiple media (e.g., a centralized or distributed database, and/or associated caches and servers) that store one or more sets of instructions 1028. The term "machine-readable medium" and "storage medium" shall also be taken to include any medium that is capable of storing, encoding, or carrying a set of instructions for execution by the processing system and that cause the processing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 1004, 1008, 1028) set at various times in various memory and storage devices in a computer, and that, when read and executed by one or more processing units or processors 1002, cause the processing system 1000 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices 1010, floppy and other removable disks, hard disk drives, optical disks (e.g., Compact Disk Read-Only Memory (CD ROMS), Digital Versatile Disks, (DVDs)), and transmission type media such as digital and analog communication links.

The network adapter 1012 enables the processing system 1000 to mediate data in a network 1014 with an entity that is external to the computing device 1000, through any known and/or convenient communications protocol supported by the processing system 1000 and the external entity. The network adapter 1012 can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 1012 can include a firewall that can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

As indicated above, the computer-implemented systems introduced here can be implemented by hardware (e.g., programmable circuitry such as microprocessors), software, firmware, or a combination of such forms. For example, some computer-implemented systems may be embodied entirely in special-purpose hardwired (i.e., non-programmable) circuitry. Special-purpose circuitry can be in the form of, for example, application-specific integrated circuits (ASICs), programmable logic devices (PLDs), field-programmable gate arrays (FPGAs), etc.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

While embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

What is claimed is:

1. A method comprising:

establishing communication between a processor and a dispensing sensor, the dispensing sensor being disposed in at least one of a container adapted to house a skin care product and a cap adapted to engage with the container;

establishing a skin care regimen for a user of the skin care product in the processor;

establishing at least one of environment data regarding an environment proximate the user and personal data regarding the user in the processor;

tailoring the skin care regimen in the processor in response to the at least one of the environment data and the personal data;

presenting information via a display regarding at least one of the skin care product and the skin care regimen;

generating dispensing sensor data from the first dispensing sensor;

communicating the dispensing sensor data from the dispensing sensor to the processor;

determining in the processor whether the skin care product has been dispensed from the dispensing sensor data;

monitoring in the processor whether the skin care product is dispensed in compliance with the skin care regimen.

2. The method of claim 1, wherein:
the processor is disposed in at least one of the container and the cap; and
the display is disposed in at least one of the container and the cap.

3. The method of claim 1, wherein:
the processor is disposed in the cap;
the display is disposed in the cap; and
the cap is adapted to removably engage with the container.

4. The method of claim 1, wherein:
the processor is disposed in a device external to the container and the cap; and
the display is disposed in a device external to the container and the cap.

5. The method of claim 4, wherein:
the device comprises at least one of a mobile phone, a tablet computer, a laptop computer, a personal data assistant, a game console, a music player, a virtual reality system, an augmented reality system, a network-connected device, a network-connected light bulb, a network-connected thermostat, a network-connected microwave, a network-connected refrigerator, a network-connected oven, a network-connected vacuum, a network-connected scale, a network-connected fitness tracker, a network-connected security system, a network-connected camera, a network-connected speaker, a network-connected wearable device, a network-connected watch, a network-connected fitness band, a network-connected computing hub, a network-connected television, and a network-connected refrigerator.

6. The method of claim 1, wherein:
the environment data comprises at least one of:
an ultraviolet level of an environment associated with the environment data;
a light level of the environment;
a temperature of the environment;
a humidity of the environment;
a pollution level of the environment;
a location of the environment; and
tailoring the skin care regimen in response thereto.

7. The method of claim 1, wherein:
the personal data comprises at least one of:
a characteristic of the user's individual's skin;
a location of the user;
a wound condition of the user;
a neonatal status of the user;
a stoma condition of the user;
a radiation treatment protocol of the user;
a medication use of the user;
a user profile of the user; and
tailoring the skin care regimen in response thereto.

8. The method of claim 1, wherein:
tailoring the skin care regimen comprises at least one of:
identifying the skin care product from among a plurality of available skin care products;
selecting whether to apply the skin care product;
adjusting how much of the skin care product to apply;
adjusting how to apply the skin care product;
adjusting how often to apply the skin care product;
adjusting a time to apply the skin care product.

9. The method of claim 1, wherein:
presenting the information via the display comprises at least one of:
skin care product information;
text instructions for complying with the regimen;
animations for applying the skin care product;
user information;
messages; and
notifications.

10. The method of claim 1, wherein:
the environment data comprises an ultraviolet level of an environment associated with the environment data;
tailoring the skin care regimen comprises selecting a moisturizer if the ultraviolet level does not exceed a threshold therefor and selecting a moisturizing sunscreen if the ultraviolet level exceeds the threshold;
presenting the information via the display comprises displaying the ultraviolet level.

11. The method of claim 1, wherein:
tailoring the skin care regimen comprises:
establishing communication between the processor and an external entity;
communicating the at least one of the environment data and the personal data from the processor to the external entity;
receiving a response from the external entity regarding the regimen; and
tailoring the skin care regimen in response to the response.

12. The method of claim 11, wherein:
the external entity comprises at least one of a cosmetic entity and a medical entity.

13. The method of claim 11, wherein:
the external entity comprises at least one of:
a cosmetic professional;
a cosmetician;
a beauty adviser;
a physician;
a dermatologist; and
a pharmacist.

14. The method of claim 11, wherein:
the external entity comprises a manufacturer of at least one of the container, the cap, the first dispensing sensor, the processor, the display, and the skin care product.

15. The method of claim 1, further comprising:
establishing two-way communication between the processor and the user via the display and a user interface;
establishing two-way communication between the processor and an external entity;
so as to enable two-way communication between the user and the external entity.

16. The method of claim 1, further comprising:
establishing two-way communication between the processor and the user via the display and a user interface;
communicating at least one question between the processor and the user;
communicating at least one response to the question between the processor and the user.

17. The method of claim 16, wherein:
the question regards at least one of:
a side effect on the user from the skin care product;
a health of the user;
an anticipated additional need for the skin care product.

18. The method of claim 16, further comprising:
forwarding the response to an external entity.

* * * * *